US005882057A

United States Patent [19]

Fahy

[11] Patent Number: 5,882,057

[45] Date of Patent: Mar. 16, 1999

[54] CONTAINER HOLDER AND CARRYING APPARATUS

[76] Inventor: Christopher Fahy, 70A Washington Pk., #3, Andover, Mass. 01810

[21] Appl. No.: 992,297

[22] Filed: Oct. 17, 1997

[51] Int. Cl.[6] ..... B65D 71/00

[52] U.S. Cl. ..... 294/159; 294/87.2; 294/170

[58] Field of Search ..... 294/33, 87.2, 87.28, 294/137, 145, 159, 170; 206/145, 159, 203, 427, 431; 220/759; 215/395–397

[56] References Cited

U.S. PATENT DOCUMENTS

| | | | |
|---|---|---|---|
| 1,005,235 | 10/1911 | Langguth | 294/159 |
| 2,264,903 | 12/1941 | Kruea | 294/87.28 |
| 2,865,669 | 12/1958 | Linthicum | 294/87.2 |
| 3,711,143 | 1/1973 | Smed . | |
| 3,784,246 | 1/1974 | Klygis . | |
| 3,815,947 | 6/1974 | Olsen . | |
| 3,860,112 | 1/1975 | Klygis . | |
| 4,569,440 | 2/1986 | Steiger | 294/87.2 |
| 5,168,990 | 12/1992 | Johnson | 294/87.2 |
| 5,188,413 | 2/1993 | Nathan | 294/159 |
| 5,191,975 | 3/1993 | Pezzoli et al. | 294/87.2 |
| 5,234,245 | 8/1993 | Peterson et al. . | |
| 5,447,259 | 9/1995 | Erickson . | |
| 5,480,204 | 1/1996 | Erickson . | |
| 5,507,544 | 4/1996 | McQuade et al. . | |

FOREIGN PATENT DOCUMENTS

| | | | |
|---|---|---|---|
| 356147 | 2/1990 | European Pat. Off. | 294/159 |
| 2271986 | 12/1975 | France | 294/159 |
| 3831-618 | 3/1990 | Germany | 206/145 |
| 2163344 | 2/1986 | United Kingdom | 294/87.2 |

*Primary Examiner*—Dean Kramer
*Attorney, Agent, or Firm*—Marc Kaufman

[57] ABSTRACT

A bottle carrier for supporting a plurality of bottles in spaced apart relationship to permit the bottles to be carried and transported in a unitary manner. The bottle carrier includes a plate having a plurality of notches formed therein that each open to a periphery of the plate. Each of the notches are configured to retain a neck, handle, or other portion of a bottle therein. A handle is defined on the plate to facilitate grasping and carrying.

4 Claims, 2 Drawing Sheets

CONTAINER HOLDER AND CARRYING APPARATUS

BACKGROUND OF THE INVENTION

1. Field of the Invention

The invention relates to an apparatus for carrying containers, and more specifically to an apparatus for carrying a plurality of liquid filled bottles or the like.

2. Description of the Related Art

Often liquids, such as water and other beverages, are sold at the retail level prepackaged in bottles, jugs, or other containers. When the containers are large, such as two liter or gallon sized, the containers can be difficult to carry. Placing the containers in bags is unwieldily, and further, conventional bags are likely to break under the load from large liquid filled containers. Also, the use of bags is environmentally unsound because of the energy and materials required to manufacture the bag and the need for disposing of the bag after use.

It is known to prepackage bottles or the like in a unitary package containing more than one bottle. However, conventional methods of such prepackaging have used a disposable member such as thin plastic bands or tape. Of course, these methods have the same drawbacks as using bags. Attempts have been made to provide reusable bottle carriers as exemplified by the disclosures of U.S. Pat. Nos. 3,815,947, 3,784,246, 3,860,112, and 3,711,143. However, known reusable bottle carriers are formed of a plurality of interlocking sheets or plates that are complex to manufacture and assemble.

SUMMARY OF THE INVENTION

It is an object of the invention to facilitate carrying a plurality of bottles or other containers.

It is another object of the invention to facilitate carrying bottles or other containers with a reusable carrier.

It is another object of the invention to simplify the construction of a carrier for bottles of other containers.

To achieve the above objects, the invention is a bottle carrier for supporting a plurality of bottles in spaced apart relationship to permit the bottles to be carried and transported in a unitary manner. The bottle carrier includes a plate having a plurality of notches formed therein that each open to a periphery of the plate. Each of the notches are configured to retain a neck portion of a bottle therein. A handle is defined on the plate to facilitate grasping and carrying.

BRIEF DESCRIPTION OF THE DRAWING

The invention is described through preferred embodiments and the attached figures in which.

DETAILED DESCRIPTION OF THE PREFERRED EMBODIMENTS

Figure 1:
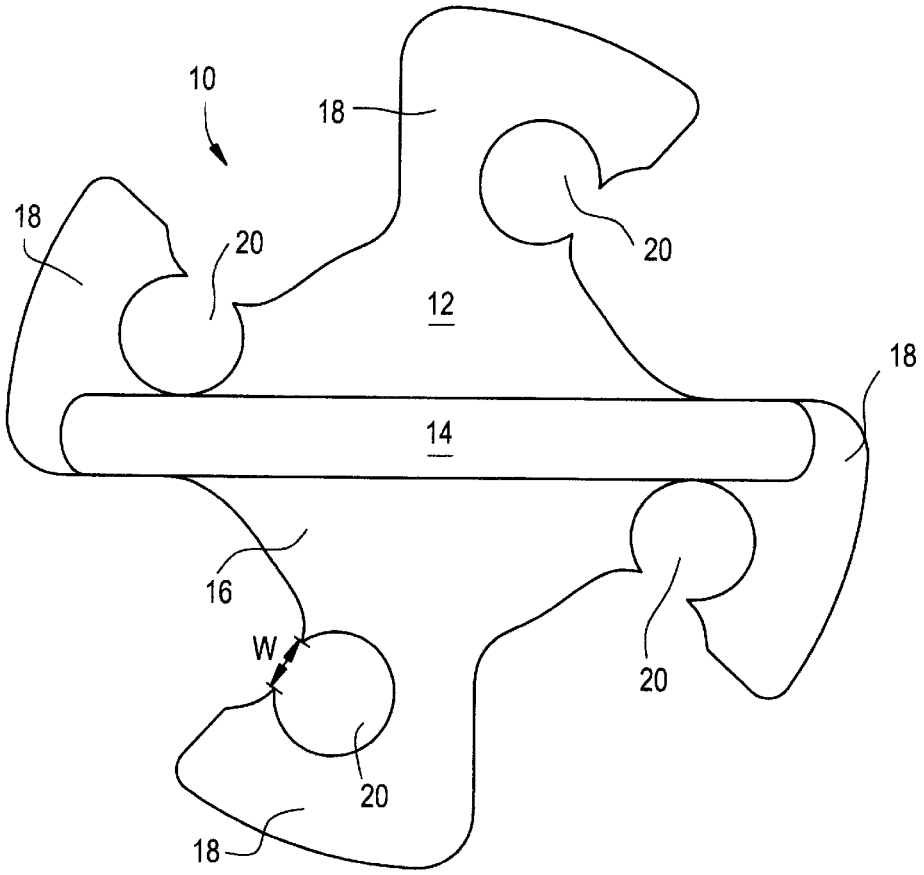
FIG. 1 is a top view of a bottle carrier according to the invention.
Figure 2:
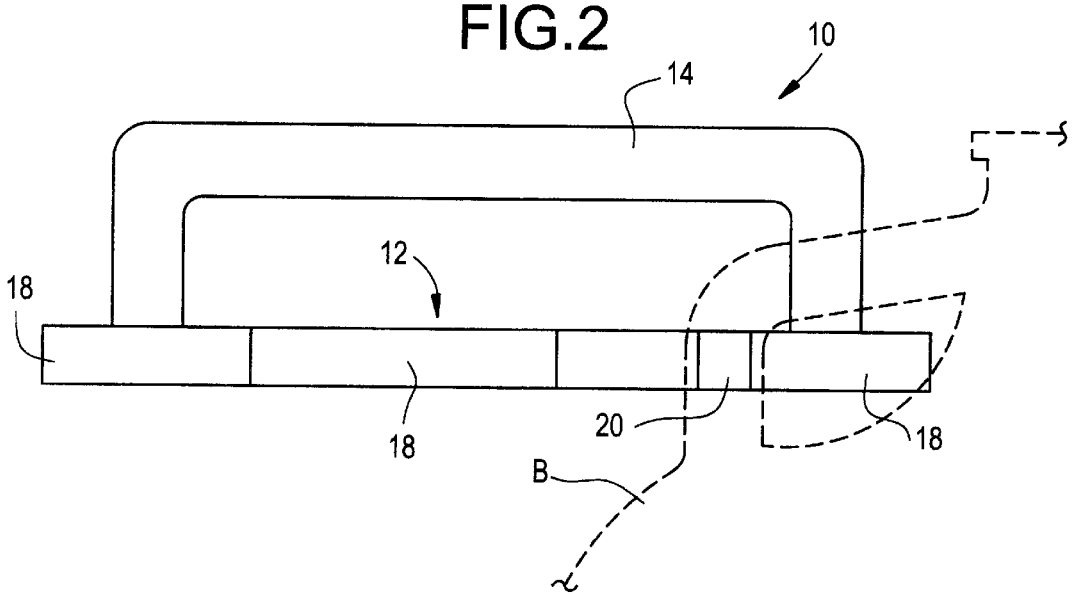
FIG. 2 is a side view of the bottle carrier of FIG. 1.

FIGS. 1 and 2 illustrate carrier 10 which includes plate 12 and handle 14 extending from plate 12. Plate 12 is constituted of central portion 16 and a plurality of extending portions 18 which extend radially from plate 12. Each of extending portions 18 has a notch 20 formed therein which opens to a periphery, i.e. the edge, of plate 12 and which is configured to accommodate the handle portion of one of the bottles or other containers to be held by carrier 10 while a top portion of the handle portion of the bottle rests on extending portion 18. For example, carrier 10 can be designed to carry 1 gallon milk containers. In such a case, each notch 20 is wide enough to accommodate the handle portion of a 1 gallon milk container. In this manner, the handle portion can be slid into notch 20 and retained therein with a handle portion of bottle B resting on plate 12, as illustrated by the dotted line in FIG. 2.

The portion of notch 20 that opens to the periphery of plate 12 can have a width w (see FIG. 1) that is wide enough to accept the handle portion of the bottle. Alternatively, width w can be slightly less than the width of the handle portion and at least part of extending portions 18 or other portions of plate 12 can be somewhat flexible to permit the width of the portion of notch 20 that opens to the periphery to be resiliently expanded to allow the handle portion of the bottle to pass therethrough into notch 20. Of course, extending portion 18 in its entirety must have sufficient rigidity to support the bottles when the carrier is lifted by handle 14. With one or more bottles secured in respective notches 20, carrier 10 can be lifted by handle 14 to permit convenient carrying of bottles or other containers.

Figure 3:
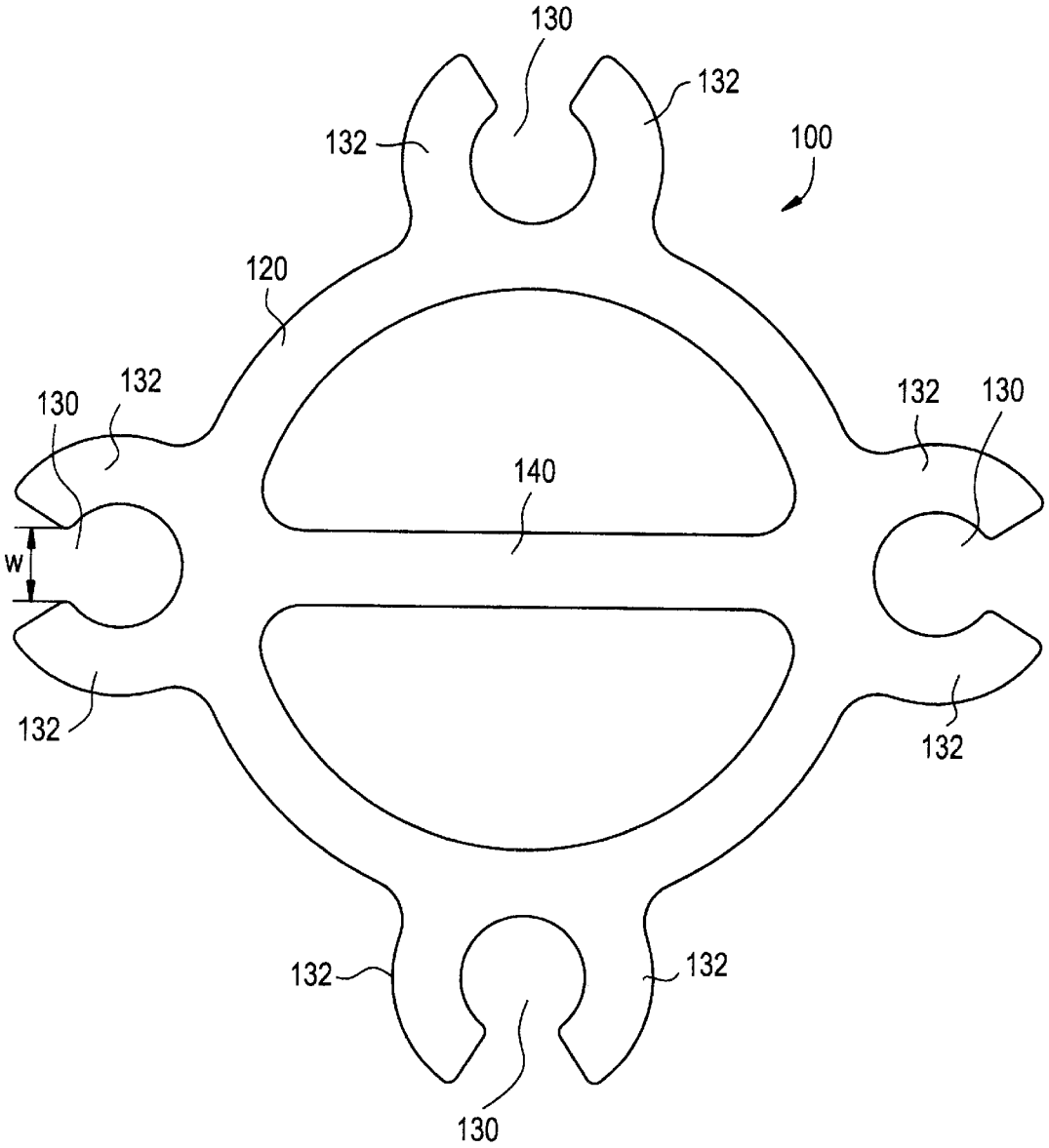
FIG. 3 is a top view of another bottle carrier according to the invention.

Another carrier 100 according to the invention is illustrated in FIG. 3. Carrier 100 includes plate 120 and handle 140 which is defined by semicircular cutouts formed in plate 120. Notches 130 are defined between pairs of arms 132, serving as extending portions of plate 120, extending from a central portion of plate 120. The portion of each of notches 130 that opens to the periphery of plate 120 can have a width w that is wide enough to accept the neck portion of the bottle. Alternatively, width w can be slightly less than the width of the neck portion and at least part of extending portions arms 132 can be somewhat flexible to permit the width of the portion of notch 130 that opens to the periphery to be resiliently expanded to allow the neck potion of the bottle to pass therethrough into notch 130. Of course, arms 132 must have sufficient rigidity to support the bottles when the carrier is lifted by handle 140. With one or more bottles secured in respective notches 130, carrier 100 can be lifted by handle 140 to permit convenient carrying of bottles or other containers.

Applicant has found that a diameter of approximately 6" will permit most common bottles to be held closely together in the carrier. However, the size and shape of the bottle carrier and the size and shape of the notches formed therein can be adjusted to accommodate any type of bottle or other container and any quantity of bottle or other container. Also, the handle can assume any suitable configuration that facilitates grasping and carrying by the user with one hand or two hands. The carrier can be made of any suitable material, an injection molded thermosetting resin for example. The carrier can be used to carry water bottles, milk bottles, juice bottles or any other appropriate container. The plate can be of any shape, but is preferably of a flat unitary, i.e. one piece, construction. The notches can be formed in any manner or appropriate shape. Any portion of the bottle can be engaged with or supported by the carrier. Finally, a magnetic element can be incorporated into the carrier to permit easy attachment to a refrigerator or other metal object during storage.

The invention has been described through preferred embodiments. However, various modifications can be made without departing from the scope of the invention as defined by the appended claims.

What is claimed is:

1. A carrier for supporting a plurality of one-gallon milk containers in spaced apart relationship to permit said containers to be carried and transported in a unitary manner, said carrier comprising:

a plate comprising a central portion and a plurality of extending portions extending radially from said central portion and having a plurality of notches formed in respective ones of said extending portions, said notches each opening to a periphery of said plate and being configured to retain a handle portion of one of said containers therein; and a handle defined on said plate and having first and second end portions, said first end portion being attached to one of said extending portions and said second end portion being attached to another of said extending portions, said handle extending beyond said notches in a radial direction of said plate.

2. A bottle carrier as recited in claim 1, wherein said notches each define a portion of a circle.

3. A carrier as recited in claim 1 wherein said plate lies in a first plane and said handle is planar and lies in a second plane that is perpendicular to said first plane.

4. A carrier for supporting a plurality of one-gallon milk containers in spaced apart relationship to permit said containers to be carried and transported in a unitary manner, said carrier comprising:

a plate, said plate comprising a central portion and a plurality of extending portions extending radially from said central portion and having a plurality of notches formed in respective ones of said extending portions, said notches being configured to retain a handle portion of one of said containers therein; and a handle defined on said plate and having first and second end portions, said first end portion being attached to one of said extending portions and said second end portion being attached to another of said extending portions.

* * * * *